US007462378B2

(12) United States Patent
Nowak et al.

(10) Patent No.: US 7,462,378 B2
(45) Date of Patent: Dec. 9, 2008

(54) METHOD FOR COATING METALS

(75) Inventors: Daniel Anthony Nowak, Greenville, SC (US); Paul Stephen DiMascio, Greer, SC (US); David Vincent Bucci, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 449 days.

(21) Appl. No.: 11/283,248

(22) Filed: Nov. 17, 2005

(65) Prior Publication Data

US 2007/0110900 A1 May 17, 2007

(51) Int. Cl.

| | |
|---|---|
| ***B05D 1/38*** | (2006.01) |
| ***C23C 4/02*** | (2006.01) |
| ***C23C 4/06*** | (2006.01) |
| ***C23C 4/12*** | (2006.01) |
| ***C23C 4/18*** | (2006.01) |
| ***H05H 1/24*** | (2006.01) |
| ***H05H 1/32*** | (2006.01) |
| *C23C 4/10* | (2006.01) |

(52) U.S. Cl. ..... 427/454; 427/455; 427/456; 427/534; 427/540; 427/405; 427/419.2; 427/419.7; 427/418

(58) Field of Classification Search ..... 427/454
See application file for complete search history.

(56) References Cited

U.S. PATENT DOCUMENTS 4,034,142 A 7/1977 Hecht
4,585,481 A 4/1986 Gupta et al.
5,187,046 A * 2/1993 Patrick et al. ..... 430/278.1
5,285,967 A 2/1994 Weidman
5,334,235 A * 8/1994 Dorfman et al. ..... 75/255
5,462,609 A 10/1995 Patrick et al.
5,466,905 A 11/1995 Flowers et al.
5,512,318 A 4/1996 Raghavan et al.
5,770,273 A 6/1998 Offer et al.
5,817,372 A * 10/1998 Zheng ..... 427/456
5,830,586 A 11/1998 Gray et al.
5,866,271 A 2/1999 Stueber et al.

(Continued)

FOREIGN PATENT DOCUMENTS

EP 1 507 018 A1 2/2005

OTHER PUBLICATIONS

"High Velocity Oxygen Fuel Thermal Spray Process", http://www.gordonengland.co.uk/hvof.htm , Nov. 14, 2005, 2 pgs.

(Continued)

*Primary Examiner*—Katherine A Bareford
(74) *Attorney, Agent, or Firm*—Cantor Colburn LLP

(57) ABSTRACT

Disclosed herein are methods for coating metal substrates, systems therefore, and articles made therefrom. In one embodiment, the method of coating a metal substrate comprises: disposing a metallic bond coating on the metal substrate, creating ions with a reverse polarity high frequency apparatus at a frequency of greater than or equal to about 2.5 kHz, roughening the surface with the ions to a subsequent average surface roughness of greater than or equal to about 5 μm, and disposing a ceramic coating on the metallic bond coating surface. The metallic bond coating had a surface with an initial average surface roughness of less than or equal to about 1 μm.

12 Claims, 1 Drawing Sheet

U.S. PATENT DOCUMENTS

| | | | | |
|---|---|---|---|---|
| 6,042,898 | A | 3/2000 | Burns et al. | |
| 6,124,563 | A | 9/2000 | Witherspoon et al. | |
| 6,511,762 | B1 * | 1/2003 | Lee et al. | 428/697 |
| 6,555,179 | B1 | 4/2003 | Reeves et al. | |
| 2005/0036892 | A1 | 2/2005 | Bajan | |

OTHER PUBLICATIONS

Y. Tamarin; "Protective Coatings for Turbine Blades", 2002, ASM International, USA, XP002413040, pp. 166-167.

European Search Report, European Application No. EP 06123921, Mailing date Jan. 29, 2007, 2 pages.

* cited by examiner

METHOD FOR COATING METALS

BACKGROUND

When exposed to high temperatures (i.e., greater than or equal to about 1,300° C.) and to oxidative environments, metals can oxidize, corrode, and become brittle. These environments are produced in turbines used for power generation applications. Thermal barrier coatings (TBC), when applied to metal turbine components, can reduce the effects that high-temperature, oxidative environments have on the metal components.

Thermal barrier coatings can comprise a metallic bond coating and a ceramic coating. The metal bond coating can comprise oxidation protection materials such as aluminum, chromium, aluminum alloys, and chromium alloys. For example, the metallic bond coating can comprise chromium, aluminum, yttrium, or combinations of the forgoing, such as MCrAlY where M is nickel, cobalt, or iron (U.S. Pat. No. 4,034,142 to Hecht, and U.S. Pat. No. 4,585,481 to Gupta et al. describe some coating materials). These metallic bond coatings can be applied by thermal spraying techniques (Gupta et al. describe the coating materials comprising silicon and hafnium particles being applied by plasma spraying). The ceramic coating can be applied to the metal bond coating by methods such as air plasma spray (APS) or electron beam physical vapor deposition (EB-PVD).

U.S. Pat. No. 6,042,898 to Burns et al., teaches applying a thermal barrier coating by depositing a MCrAlY bond coat onto a superalloy substrate. Burns et al. teach forming an aluminum oxide scale on a MCrAlY bond coat and depositing a ceramic layer on the aluminum oxide scale using physical vapor deposition. Burns et al. teach enhanced coating life using an ionized gas cleaning process, such as reverse transfer arc cleaning. This process entails forming an arc that superheats oxides and other contaminants on the blade's surface, causing the oxides and contaminants to vaporize. The process is performed at pressures of 30 torr absolute (4.0 kPa) to 40 torr absolute (5.3 kPa) and temperatures of 1,400° F. (760° C.) to 1,600° F. (871° C.).

When the ceramic coatings are applied to the metallic bond coating comprising aluminized MCrAlY and/or over dense high velocity oxy-fuel flame (HVOF) coatings, the ceramic coating can exhibit poor adhesion. HVOF is a supersonic process, which can deliver gas velocities at over 6,000 feet per second (fps), that allows particle velocities of over 3,000 fps and that can produce coatings with high bond strengths. It is an extremely versatile system that offers an unlimited range of possibilities to industries with extreme corrosion and wear environments. However, the resultant coatings are smooth and enable limited adhesion with subsequent coatings. Hence, there exists a need for an improved method to adhere a ceramic coating to these smooth coatings.

SUMMARY OF THE INVENTION

Disclosed herein are methods for coating metal substrates, systems therefore, and articles made therefrom. In one embodiment, the method of coating a metal substrate comprises: disposing a metallic bond coating on the metal substrate, creating ions with a reverse polarity high frequency apparatus at a frequency of greater than or equal to about 2.5 kHz, roughening the surface with the ions to a subsequent average surface roughness of greater than or equal to about 5 μm, and disposing a ceramic coating on the metallic bond coating surface. The metallic bond coating had a surface with an initial average surface roughness of less than or equal to about 1 μm.

In one embodiment, the system for coating a metal substrate comprises: a first coating apparatus capable of disposing a coating having an initial average surface roughness of less than or equal to about 1 μm, an ionized gas apparatus capable of operating at a frequency of greater than or equal to about 2.5 kHz, and of creating and directing ions at the coating to form a roughened coating having a subsequent average surface roughness of greater than or equal to about 5 μm, and a second coating apparatus capable of disposing a ceramic coating on the roughened coating.

In one embodiment, a coated substrate comprises an HVOF metallic bond coating on the substrate. The HVOF metallic bond coating has a subsequent average surface roughness of greater than or equal to about 5 μm.

The above described and other features are exemplified by the following figure and detailed description.

BRIEF DESCRIPTION OF THE DRAWINGS

Refer now to the figure, which is an exemplary embodiment.

DETAILED DESCRIPTION

Figure 1:
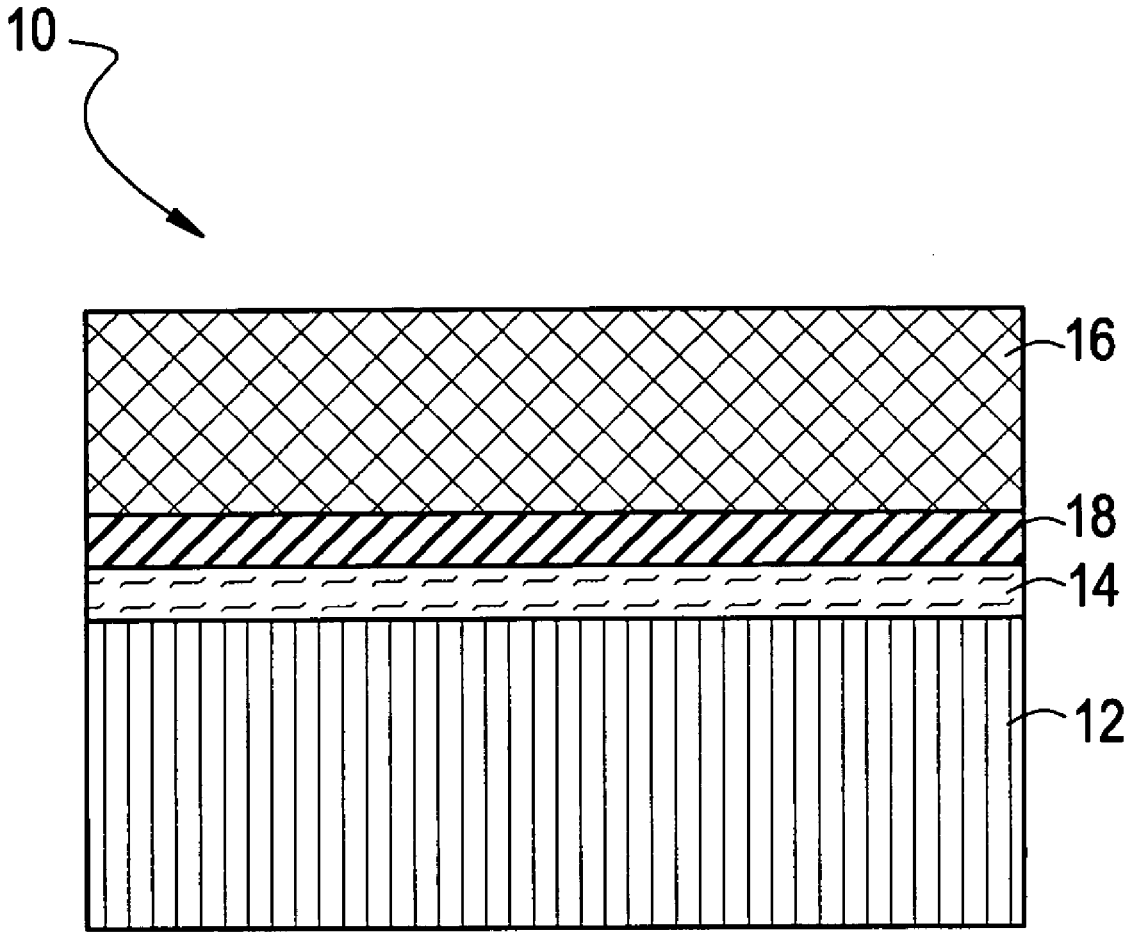
FIG. 1 is a side view of a metal substrate with a metallic bond coating and a ceramic coating disposed thereon.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 wt %, or, more specifically, about 5 wt % to about 20 wt %", is inclusive of the endpoints and all intermediate values of the ranges of "about 5 wt % to about 25 wt %," etc).

FIG. 1 illustrates a metal-ceramic composite 10 comprising a metallic bond coating 14 applied to a metal substrate 12. The metallic bond coating 14 is treated to provide higher average surface roughness for adhesion prior to the application of a ceramic coating 16.

The metal substrate 12 can represent various components employed with barrier coatings, such as, for example, buckets, nozzles, blades, vanes, shrouds, as well as other components, for example, components that will be disposed in a hot gas stream in a turbine engine. This metal substrate 12 can comprise various metals employed in such applications including nickel, cobalt, iron, combinations comprising at least one of the foregoing, as well as alloys comprising at least one of the foregoing, such as a nickel-base superalloy, and/or a cobalt-based superalloy.

The metallic bond coating 14 adheres to the metal substrate 12. Therefore, compatibility and good adhesion are factors considered in choosing a bond coating material. The metallic bond coating can comprise nickel (Ni), cobalt (Co), iron (Fe), chromium (Cr), aluminum (Al), yttrium (Y), alloys comprising at least one of the foregoing, as well as combinations comprising at least one of the foregoing, e.g., the metallic bond coating can comprises MCrAlY (where M consists of nickel, cobalt, iron, and combinations comprising at least one of the forgoing). An MCrAlY coating can further comprise elements such as silicon (Si), ruthenium (Ru), iridium (Ir), osmium (Os), gold (Au), silver (Ag), tantalum (Ta), palladium (Pd), rhenium (Re), hafnium (Hf), platinum (Pt), rhodium (Rh), tungsten (W), alloys comprising at least one of the foregoing, as well as combinations comprising at least one of the foregoing. For example, the metallic bond coat can comprise sufficient aluminum to form an alumina scale on the surface of the metallic bond coating 14. The aluminum can be in the form of an aluminide that optionally comprises ruthenium (Ru), iridium (Ir), osmium (Os), gold (Au), silver (Ag), palladium (Pd), platinum (Pt), rhodium (Rh), alloys comprising at least one of the foregoing, as well as combinations comprising at least one of the foregoing.

Application of the metallic bond coating 14 to the substrate 12, which can be accomplished in a single or multiple stages, can be accomplished in various fashions, including vapor deposition (e.g., electron beam physical vapor deposition (EB-PVD), chemical vapor deposition (CVD), and so forth), electroplating, ion plasma deposition (IPD), plasma spray (e.g., vacuum plasma spray (VPS), low pressure plasma spray (LPPS), air plasma spray (APS), and so forth), thermal deposition (e.g., high velocity oxidation fuel (HVOF) deposition, and so forth), and so forth, as well as combinations comprising at least one of the foregoing processes. For example, metallic bond coating components can be combined (e.g., by induction melting, and so forth), powderized (e.g., by powder atomization), a plasma sprayed onto the substrate 12. Alternatively, or in addition, the metallic bond coating elements can be incorporated into a target and ion plasma deposited. Where multiple stages are employed, the same or different elements can be applied to the substrate during each phase. As an example, a precious metal (e.g., platinum) can be applied by a technique that reduces waste, followed by another process to apply the remaining elements. Therefore, the precious metal can be electroplated onto the substrate surface, and the other elements can be applied by the thermal deposition (e.g., by HVOF) of a powder composition. Aluminiding can then be carried out, e.g., to attain intermixing of the precious metal with the rest of the coating composition.

For example, metal material (e.g., in the form of wire, rod, and so forth) can be applied to a substrate. The metal material can be feed fed into an oxy-acetylene flame. The flame melts the metal material and atomizes the particle melt with an auxiliary stream of high pressure air that deposits the material as a coating on the substrate. Flameless spray apparatus can also be employed, such as those disclosed in U.S. Pat. No. 5,285,967 to Weidman. The HVOF process produces smooth coatings, e.g., a coating having a $R_a$ of less than or equal to about 1 μm (50 microinches).

The thickness of the metallic bond coating 14 depends upon the application in which the coated component is used and the application technique. The coating can be applied to turbine components at a thickness of about 50 micrometers (μm) to about 625 μm, or, more specifically, about 75 μm to about 425 μm.

The metallic bond coating 14 is treated to roughen the surface prior to the application of the ceramic coating 16. The treatment can include a reverse polarity process (e.g., a reverse polarity high frequency arc process, i.e., a frequency of greater than or equal to about 2.5 kilohertz (kHz)) under sufficiently harsh conditions to roughen the metallic bond coating 14 instead of merely clean the coating. The reverse polarity process, which can use a torch gun (e.g., a tungsten torch arc welding gun), can employ alternating current (AC) reverse arc or direct current (DC) reverse arc. The reverse polarity process uses an inert gas (e.g., helium, argon, and so forth), and/or other gases (e.g., hydrogen, nitrogen, and so forth) that do no chemically react with the substrate 12 or metallic bond coating 14, as well as combinations comprising at least one of these gases, which flows through the torch. A reverse polarity, high frequency is created (e.g., struck), causing electrons to be stripped from the gas. The ions formed by stripping the electrons strikes the surface of the metallic bond coating.

Not to be bound by theory, the arc apparatus is operated at a high frequency and such that no arc is formed between the apparatus and the metallic bond coating. As the electrons are stripped from the gas, the ions formed thereby strike and roughen the surface of the coating without leaving residue. Due to the low amperage employed (e.g., less than or equal to about 10 amps, or, more specifically, less than or equal to about 3 amps), and since the electrons flow toward the apparatus while the ions flow toward the substrate, the temperature of the substrate is not substantially increased by this process; e.g., the increase in temperature is less than or equal to about 10° C., or, more specifically, less than or equal to about 5° C.

For example, the arc can be created with a positive electrode and with the metallic bond coating 14 as a negative electrode. A potential is then created between the electrodes at a low amperage; e.g., a potential of about 10 volts (V) to about 50 V, at less than or equal to about 10 amps, or, more specifically, less than or equal to about 2 amps. After establishing the arc, a potential is maintained between the electrodes sufficient to roughen the metallic bond coating surface. For example, a potential of about 10 V to about 50 V at about 0.1 amperes (amps) to about 10 amps. The roughening time is variable based on the metallic coating surface area, as well as its composition. The times can be up to about 10 minutes, or, more specifically, about 1 minute to about 5 minutes. It is understood that combinations of potentials, amperages, and times can be chosen within the above ranges to merely clean the surface of the coating. For example, the time can be too short to enable roughening at the given potential and amperage. However, such a combination will not be sufficient to attain the adhesion sought herein. The combination herein should be sufficient to attain an average surface roughness of greater than or equal to about 5 μm, as measured in accordance with American National Standards Institute (ANSI) B46.1, at an 0.030 inch (about 0.76 millimeters) cut-off.

Not to be bound by theory, the torch gun operated at high frequency causes the formation of inert gas ions that bombard the surface of the metallic bond coating 14 that break the oxide bonds thereon and change the surface morphology, thereby increasing the average surface roughness and forming a roughened surface 18. The coating treatment can increase the average surface roughness ($R_a$) to greater than or equal to about 5 μm (200 microinches), or, more specifically, about 9 μm (350 microinches) to about 15 μm (600 microinches), and even more specifically, about 10 μm (400 microinches) to about 13 μm (500 microinches).

Once the desired average surface roughness has been attained, the arc is ceased and a ceramic layer can be applied. A ceramic layer, specifically the ceramic coating 16 can be applied to the roughened surface 18 of the metallic bond coating 14. The ceramic coating 16 can comprise a ceramic capable of protecting the metallic bond coating 14 and the substrate 12 from oxidizing. Possible ceramics include zirconia ($ZrO_2$), alumina ($Al_2O_3$), and so forth, that are optionally stabilized. Possible stabilizers include yttrium (Y), cerium (Ce), barium (Ba), lanthanum (La), magnesium (Mg), scandium (Sc), calcium (Ca), and so forth, oxides comprising at least one of the foregoing, as well as combinations comprising at least one of the foregoing, such as yttria-stabilized zirconia.

The ceramic coating 16 can be applied by various techniques such as those discussed above in relation to the application of the metallic bond coating 14. The thickness of the ceramic coating 16 can be up to about 1,750 μm or more, or, more specifically, about 250 μm to about 1,500 μm, and still more specifically, about 350 μm to about 1,250 μm.

The use of the reverse polarity, high frequency treatment to roughen the metallic bond coating (e.g., a MCrAlY bond coating), and particularly a coating that has been applied using an HVOF process, enhances adhesion of the bond coating to the subsequent ceramic coating applied thereto. The enhanced adhesion extends the life of the coating. HVOF applied coatings tend to have a very smooth surface (e.g., $R_a$ of less than 1 μm) that is not conducive to receiving a subsequent coating. By roughening the surface, e.g., to an average surface roughness of greater than or equal to about 5 μm, adhesion between the HVOF and subsequent coating is greatly enhanced.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for coating a metal substrate, comprising:

disposing a metallic bond coating on the metal substrate, wherein the metallic bond coating has a surface with an initial average surface roughness of less than or equal to about 1 μm;

creating ions with a reverse polarity high frequency apparatus at a frequency of greater than or equal to about 2.5 kHz;

roughening the surface with the ions to a subsequent average surface roughness of greater than or equal to about 5 μm; and disposing a ceramic coating on the metallic bond coating surface.

2. The method of claim 1, wherein disposing the metallic bond coating further comprises thermal spraying metallic bond coating elements onto the substrate.

3. The method of claim 2, wherein the thermal spraying is high velocity oxy-fuel flame spraying.

4. The method of claim 1, wherein the metallic bond coating comprises MCrAlY, wherein M is selected from the group consisting of nickel, cobalt, iron, and combinations comprising at least one of the foregoing.

5. The method of claim 4, wherein the metallic bond coating further comprises an element selected from the group consisting of silicon, ruthenium, iridium, osmium, gold, silver, tantalum, palladium, rhenium, hafnium, platinum, rhodium, tungsten, alloys comprising at least one of the foregoing, and combinations comprising at least one of the foregoing.

6. The method of claim 5, wherein the metallic bond coating comprises an element selected from the group consisting of ruthenium, iridium, osmium, gold, silver, tantalum, palladium, rhenium, platinum, rhodium, tungsten, alloys comprising at least one of the foregoing, and combinations comprising at least one of the foregoing.

7. The method of claim 1, wherein creating the ions comprising using an amperage of less than or equal to about 10.

8. The method of claim 7, wherein the amperage is less than or equal to about 5.

9. The method of claim 8, wherein the amperage is less than or equal to about 3.

10. The method of claim 1, wherein the ceramic coating comprises zirconia.

11. The method of claim 1, wherein the subsequent average surface roughness is about 9 μm to about 15 μm.

12. The method of claim 11, wherein the subsequent average surface roughness is about 10 μm to about 13 μm.

* * * * *